US009982856B2

(12) United States Patent
Wang et al.

(10) Patent No.: US 9,982,856 B2
(45) Date of Patent: May 29, 2018

(54) LIGHTING ASSEMBLY

(71) Applicants: LITE-ON ELECTRONICS (GUANGZHOU) LIMITED, Guangzhou (CN); LITE-ON TECHNOLOGY CORPORATION, Taipei (TW)

(72) Inventors: Shih-Chang Wang, New Taipei (TW); Pin-Hao Hsu, Taoyuan (TW); Po-Chang Li, Taoyuan (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 80 days.

(21) Appl. No.: 15/133,421

(22) Filed: Apr. 20, 2016

(65) Prior Publication Data

US 2017/0167676 A1 Jun. 15, 2017

(30) Foreign Application Priority Data

Dec. 14, 2015 (CN) ..... 2015 2 1042914 U

(51) Int. Cl.

| | |
|---|---|
| ***F21S 8/08*** | (2006.01) |
| ***F21S 13/10*** | (2006.01) |
| ***F21V 21/26*** | (2006.01) |
| ***F21V 21/10*** | (2006.01) |
| ***F21V 21/112*** | (2006.01) |
| ***F21V 21/30*** | (2006.01) |

(52) U.S. Cl.
CPC ..... *F21S 8/086* (2013.01); *F21V 21/112* (2013.01); *F21V 21/30* (2013.01)

(58) Field of Classification Search
CPC ..... F21S 8/08–8/088; F21V 19/02; F21V 21/116; F21V 21/14
See application file for complete search history.

(56) References Cited

U.S. PATENT DOCUMENTS

| | | | | |
|---|---|---|---|---|
| 2,778,929 A * | 1/1957 | Loehr | ..... | F21S 8/086 164/DIG. 4 |
| 3,032,648 A * | 5/1962 | Pfaff, Jr. | ..... | F21S 8/086 362/370 |
| 3,561,682 A * | 2/1971 | Rex | ..... | F21S 8/086 362/269 |

(Continued)

*Primary Examiner* — Mariceli Santiago
(74) *Attorney, Agent, or Firm* — Li & Cai Intellectual Property (USA) Office

(57) ABSTRACT

A lighting assembly is assembled on a light pole. The lighting assembly comprises a lighting portion, an assembling portion, a first fixing member and a second fixing member. The lighting portion has a light-output surface. The assembling portion is connected to the lighting portion, and the assembling portion has a holder. The holder is configured to hold a free end of the light pole, and inner diameters of the holder gradually decrease from an outer end surface to the lighting portion, such that the free end abuts an inner wall of the holder. The first fixing member passes through a through-hole of a first side of the holder; the second fixing member passes through a through-hole of a second side of the holder, wherein the second side is opposite to the first side.

13 Claims, 10 Drawing Sheets

(56) References Cited

U.S. PATENT DOCUMENTS

| | | | | |
|---|---|---|---|---|
| 8,007,142 | B2 * | 8/2011 | Ku | F21V 21/116 248/125.2 |
| 8,925,884 | B2 * | 1/2015 | Schultz | F21V 21/116 248/230.1 |
| 2010/0097815 | A1 * | 4/2010 | Song | F21S 8/086 362/418 |
| 2010/0214775 | A1 * | 8/2010 | Liang | F21S 8/086 362/184 |

* cited by examiner

LIGHTING ASSEMBLY

TECHNICAL FIELD

The present invention relates to a lighting assembly, particularly a lighting assembly in which a light-output angle can be adjusted.

BACKGROUND ART

After mounting a lighting assembly onto a light pole, a light-output angle of the lighting assembly needs to be adjusted to achieve an optimal lighting angle, so as to provide a safe road condition for drivers and pedestrians.

SUMMARY OF THE INVENTION

The present invention relates to a lighting assembly in which a light-output angle can be adjusted. In one embodiment of the present invention, a light assembly configured to be assembled to a light pole is provided. The lighting assembly comprises a lighting portion, an assembling portion, a first fixing member and a second fixing member. The lighting portion has a light-output surface; the assembling portion is coupled to the lighting portion, and the assembling portion has a holder. The holder includes a cone-cylinder space configured to hold a free end of the light pole. The first fixing portion passes through a through-hole of a first side of the holder configured to abut the light pole; the second fixing portion passes through a through-hole of a second side of the holder, wherein the second side is opposite to the first side.

Therefore, an angle of the light-output surface is adjusted through adjusting the first fixing portion and the second fixing portion of the lighting assembly, so as to adjust the light-output angle of the lighting assembly.

In order to further understand the features and technical content of the present invention, reference can be made to the detailed description and accompanying drawings of the present invention. However, the accompanying drawings are only provided for reference and illustration, but not intended to limit the present invention.

DETAILED DESCRIPTION OF THE PREFERRED EMBODIMENTS

Figure 1:
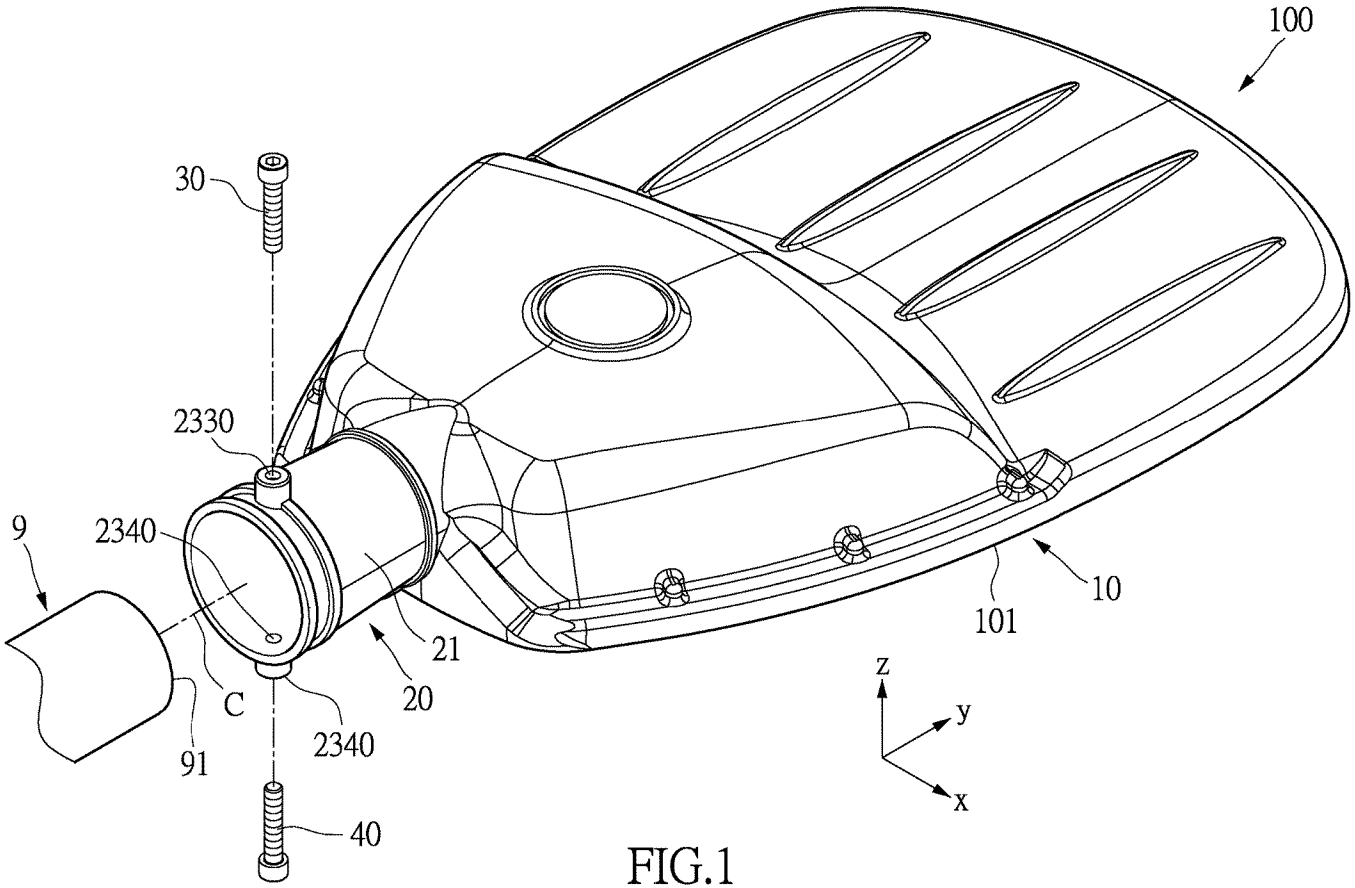
FIG. 1 is an exploded view of a lighting assembly and a light pole according to the present invention.

FIG. 1 is an exploded view of a lighting assembly 100 and a light pole 9 of one embodiment of the present invention. The present invention discloses a lighting assembly 100. The lighting assembly 100 comprises a lighting portion 10, an assembling portion 20, a first fixing member 30 and a second fixing member 40. The assembling portion 20 is coupled to the lighting portion 10, the lighting portion has a light-output surface 101. In this embodiment, a light source of the lighting portion 10 includes LED. In some embodiments, a light source of the lighting portion 10 includes a light bulb.

In this embodiment, the assembling portion 20 comprises a holder 21 configured to hold a free end 91 of a light pole 9, such that the lighting assembly 100 is assembled to the light pole 9.

Figure 2:
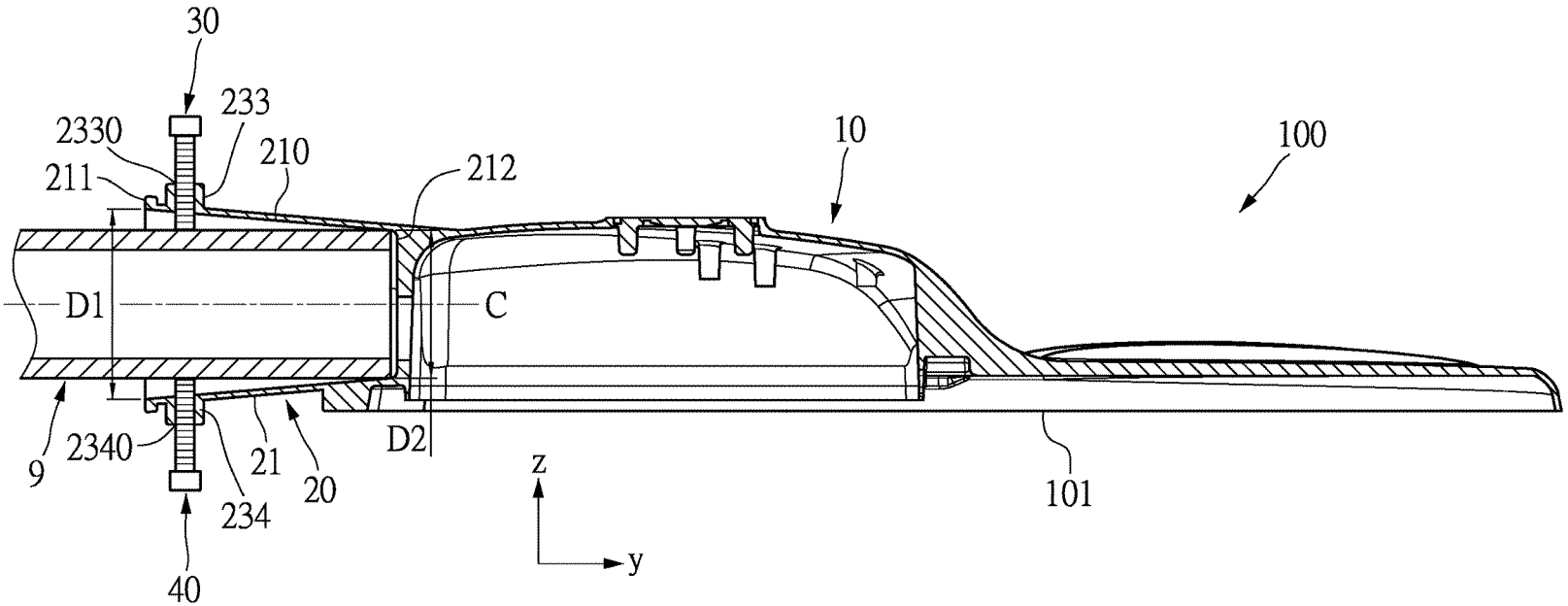
FIG. 2 is a cross-sectional view of a street lamp of one embodiment of the present invention.

FIG. 2 is a cross-sectional view of a street lamp of one embodiment of the present invention. In this embodiment, the street lamp includes the lighting assembly 100 assembled to the light pole 9. As shown in FIG. 2, the first fixing member 30 passes through a through-hole 2330 of a first side of the holder 21 and abuts the light pole 9. The second fixing member 40 passes through a through-hole 2340 of a second side of the holder 21 and abuts the light pole 9, wherein the second side is opposite to the first side. In this embodiment, the first side is the side opposite to the light-output surface 101; the second side is the side of the light-output surface 101. The holder 21 in this embodiment is approximately in the shape of a truncated conical tube, inner diameters of the holder 21 gradually decrease from an outer end surface 211 towards the lighting portion 10, so as to form a cone-cylinder space, such that the free end 91 of the light pole 9 abuts an inner wall 210 of the holder 21. Therefore, the holder 21 in this embodiment can hold light poles 9 having different diameters.

As shown in FIG. 2, the lighting assembly 100 in this embodiment is firmly assembled to the light pole 9 by the first fixing member 30 and the second fixing member 40 along the longitudinal direction of the lighting assembly 100 and the direction passing through axis C of the holder 21 (as shown in FIG. 1). Even if the outer diameter of the light pole 9 is less than the minimum inner diameter of the holder 21, the lighting assembly 100 in this embodiment can still be firmly assembled to the light pole 9 by a plurality of fixing members.

Figure 3:
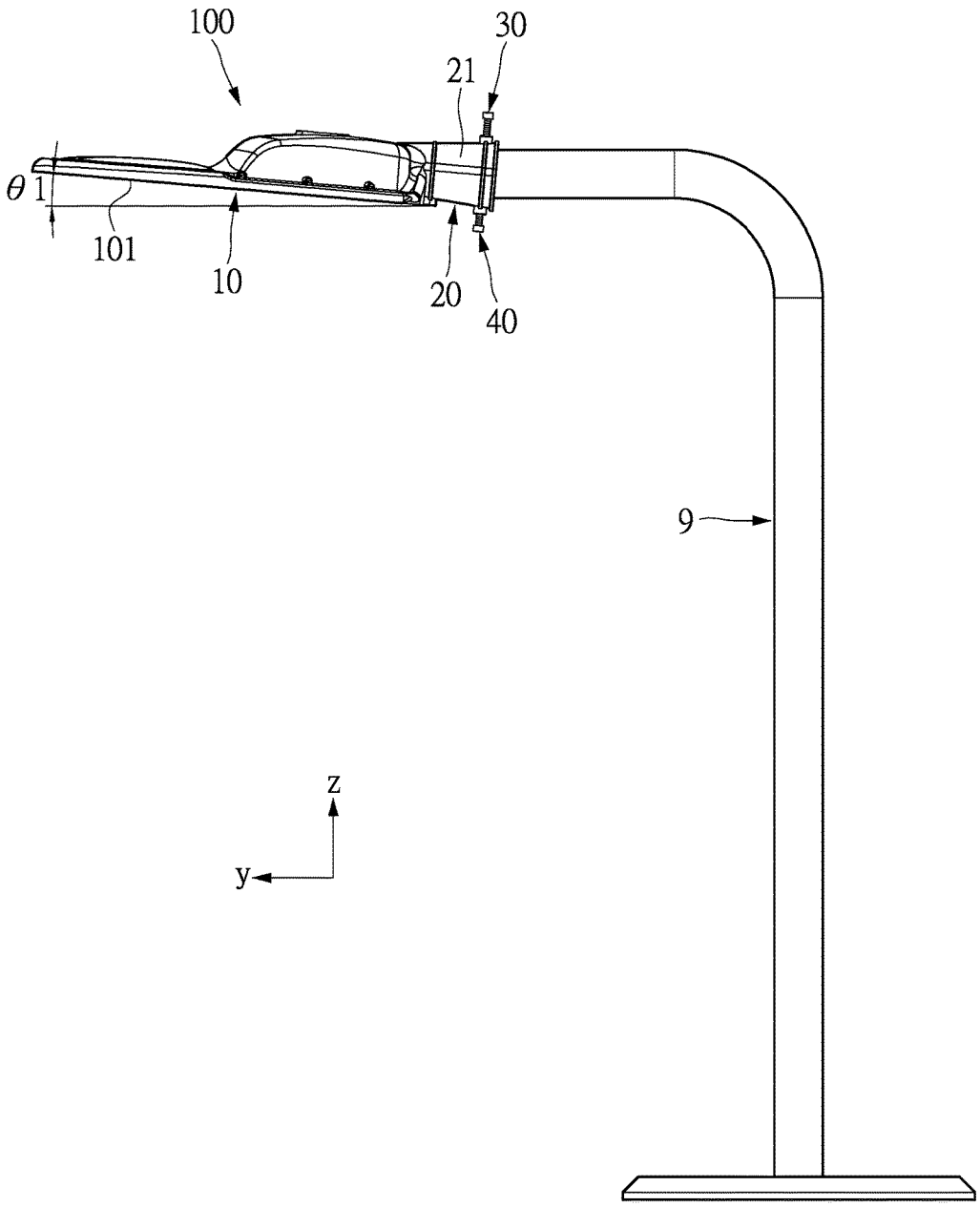
FIG. 3 is a side view of the lighting assembly adjusted to a light-output angle according to the present invention.
Figure 4:
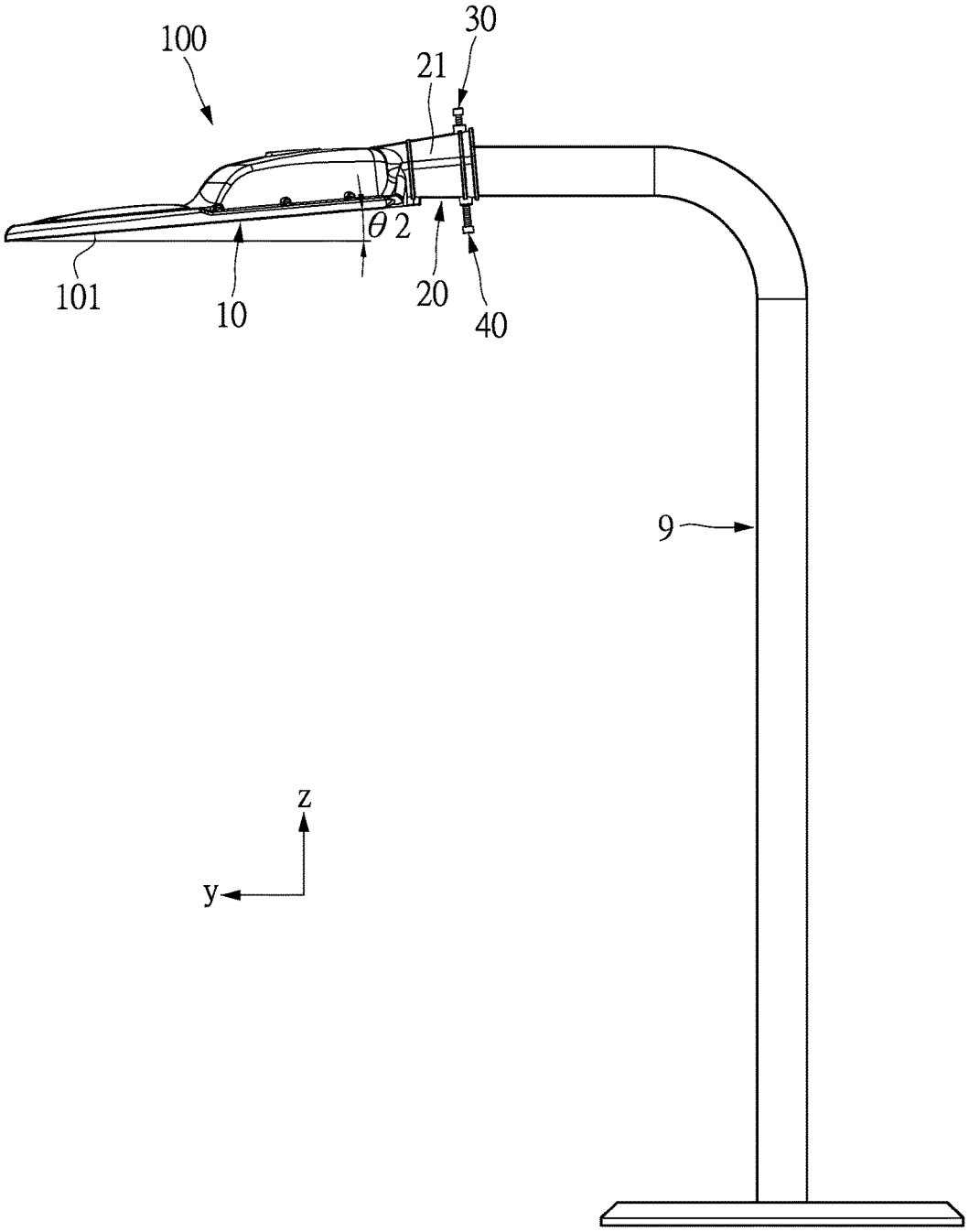
FIG. 4 is a side view of the lighting assembly adjusted to another light-output angle according to the present invention.

As shown in FIG. 3 and FIG. 4, for the lighting assembly 100 in this embodiment, relative displacement between the first fixing member 30, the second fixing member 40 and the light pole 9 is adjusted to change the angle of the light-output surface 101 of the lighting portion 10, so as to adjust the light-output angle of the lighting assembly 100. In this embodiment, the first fixing member 30 and the second fixing member 40 each comprise a screw.

As shown in FIG. 3, rotating the first fixing member 30 on the holder 21 upward leads to rotation of the first fixing member 30 away from the light pole 9, and rotating the second fixing member 40 upward leads to rotation thereof toward the light pole 9. Therefore, the light-output surface 101 forms an included angle θ1 with a horizontal plane. In this embodiment, the included angle θ1 is in a range between 5 and 15 degrees. Therefore, an angle of the light-output surface 101 of the lighting portion 10 can be adjusted in this embodiment, further achieving adjustment of the light output angle of the lighting assembly.

As shown in FIG. 4, rotating the first fixing member 30 on the holder 21 downward leads to rotation of the first fixing member 30 toward the light pole 9, and rotating the second fixing member 40 downward leads to rotation thereof away from the light pole 9. Therefore, the light-output surface 101 of the lighting assembly 100 will form an included angle θ2 with a horizontal plane. In this embodiment, the included angle θ2 is approximately in a range between 5 and 15 degrees.

Figure 5:
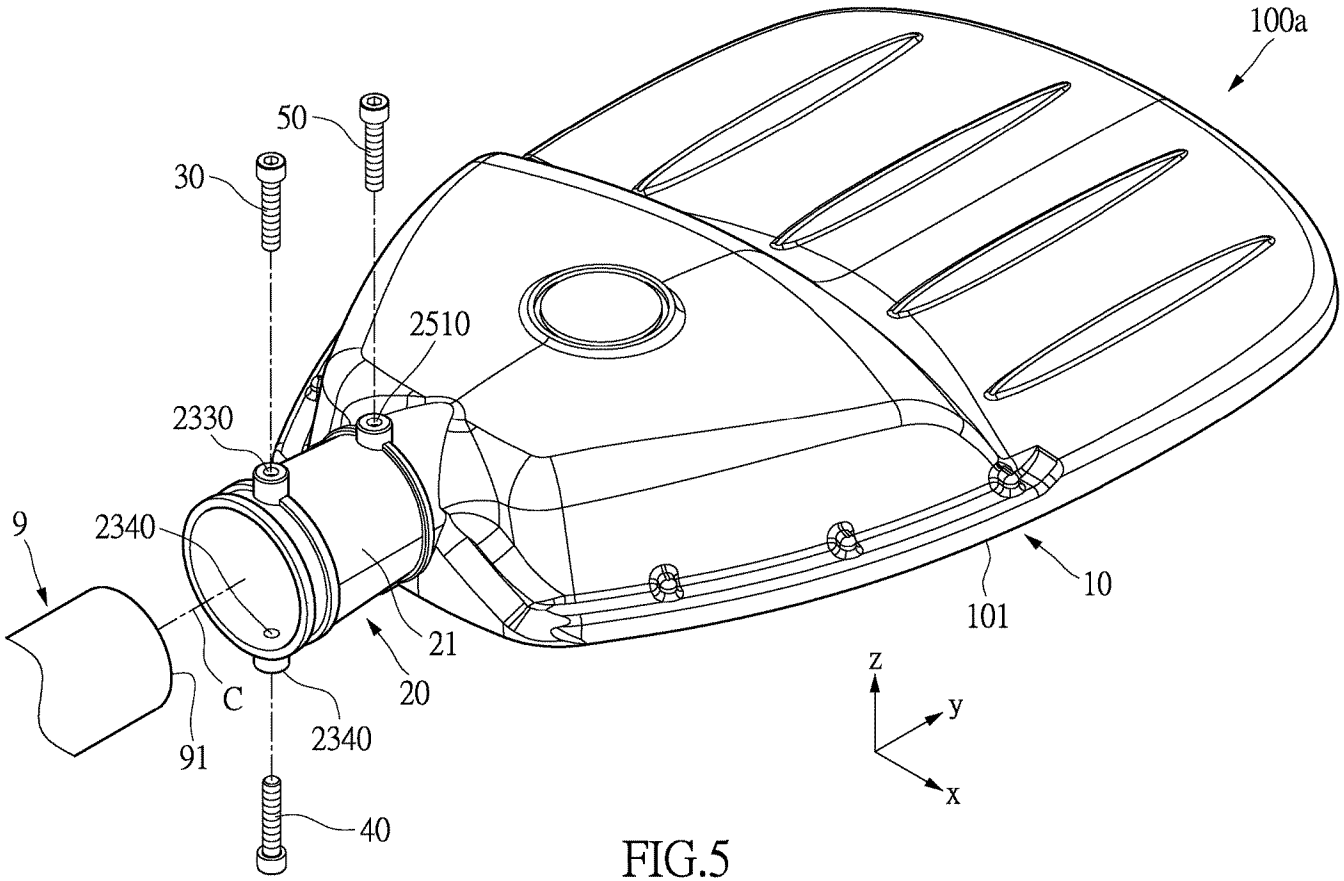
FIG. 5 is an exploded view of a lighting assembly and a light pole according to a second embodiment of the present invention.

FIG. 5 is an exploded view of a lighting assembly 100*a* and a light pole 9 according to another embodiment of the present invention. As shown in FIG. 5, the lighting assembly 100*a* is similar to the lighting assembly 100 as shown in FIG. 2, but further comprises a third fixing member 50. The third fixing member 50 passes through another through-hole 2510 on the first side of the holder 21 and abuts the light pole 9. The first fixing member 30 is located on an end proximal to the light pole 9; the third fixing member 50 is located on an end of the holder 21 proximal to the lighting portion 10. In this embodiment, the third fixing member 50 comprises a screw.

Figure 6:
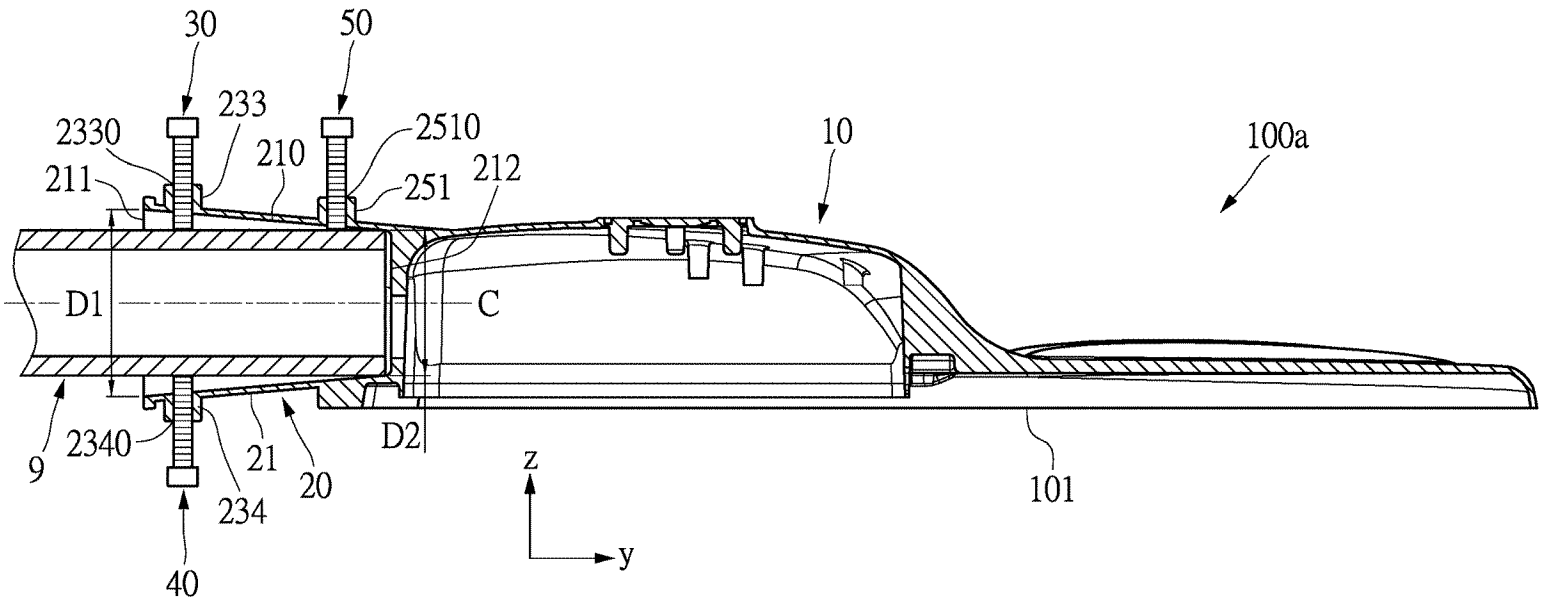
FIG. 6 is a cross-sectional view of a lighting assembly according to the second embodiment of the present invention.

FIG. 6 is a cross-sectional view of a lighting assembly 100*a* and a light pole 9 assembled according to another embodiment of the present invention. As shown in FIG. 6, the first fixing member 30, the second fixing member 40 and the third fixing member 50 are arranged in a triangle, firmly fixing the lighting assembly, to avoid the lighting assembly from shaking upward and downward. Furthermore, along the cross-sectional profile of FIG. 6 perpendicular to the light-output surface 101 (which is parallel with the ZY plane and passes through the axis C of the holder 21), an inner diameter D1 of the outer end surface 211 of the holder 21 is greater than an inner diameter D2 of an inner end surface 212 of the holder 21, forming a tapered inner wall 210. Therefore, the present embodiment can be applied to light poles 9 having different diameters. Besides, the cone-cylinder space of the holder 21 allows the lighting portion 10 to adjust an angle of the light-output surface 101.

Figure 7:
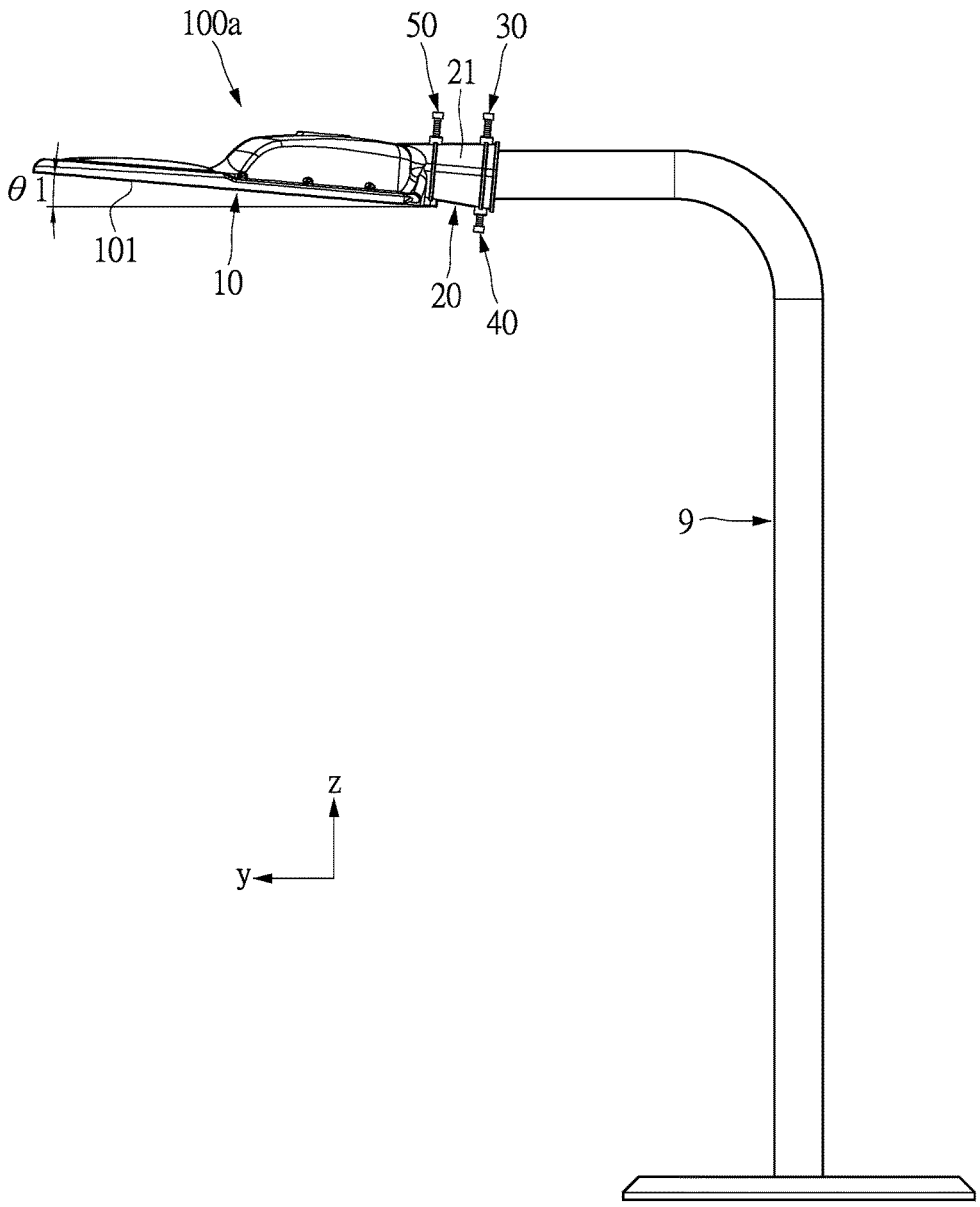
FIG. 7 is a side view of the lighting assembly according to the second embodiment of the present invention with a light-output angle.
Figure 8:
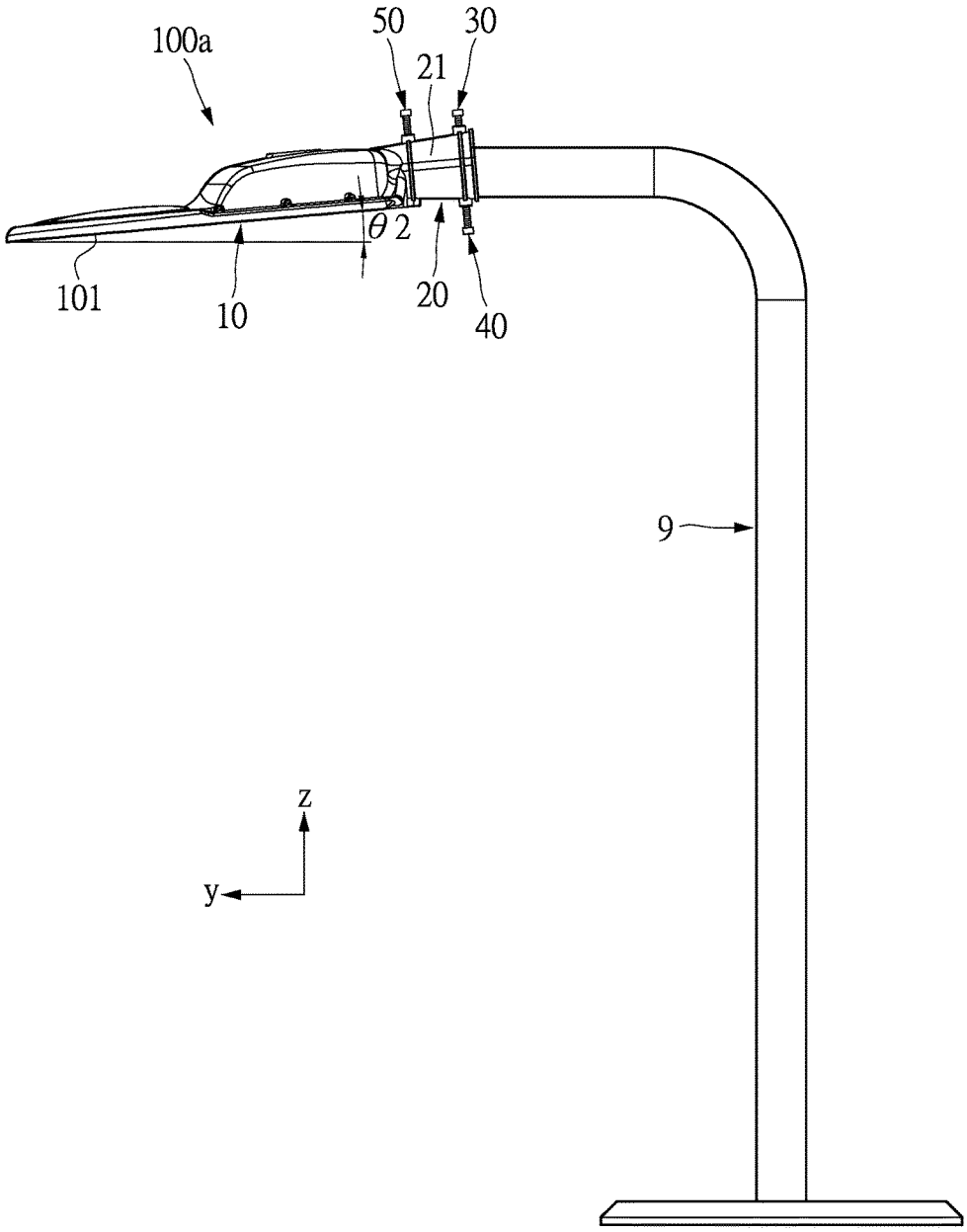
FIG. 8 is the side view of the lighting assembly according to the second embodiment of the present invention with another light-output angle.

As shown in FIG. 7 and FIG. 8, for the lighting assembly 100*a* in this embodiment, the angle of the light-output surface 101 of the lighting portion 10 is adjusted by adjusting relative displacement between the first fixing member 30, the second fixing member 40, the third fixing member 50 and the light pole 9, so as to adjust the light-output angle of the lighting assembly 100*a*. As shown in FIG. 7, through rotating the third fixing member 50 on the holder 21 downward to abut the light pole 9, the lighting portion 10 can be adjusted to form an angle slightly upward from the direction parallel to ground. If a greater adjustment of angle is required, the second fixing member 40 may be further rotated toward the light pole 9, and the first fixing portion 30 may be rotated away from the light pole 9. Therefore, the light-output surface 101 forms an included angle θ1 with a horizontal plane along the longitudinal direction of the lighting assembly 100*a* and the axial direction passing through the holder 21, namely on the ZY plane as shown in FIG. 7. In this embodiment, the included angle θ1 is in a range between 5 and 15 degrees.

As shown in FIG. 8, the light-output surface 101 of the lighting assembly 100*a* forms an included angle θ2 with the horizontal plane through an adjustment of the first fixing member 30, namely downward movement of the first fixing member 30 toward the light pole 9 and corresponding outward movement of the second fixing member 40 away from the light pole 9, wherein the third fixing member 50 may remain unmoved. If necessary, a position of the third fixing member 50 may also be adjusted accordingly. In this embodiment, the included angle θ2 is in a range between 5 and 15 degrees.

Figure 9:
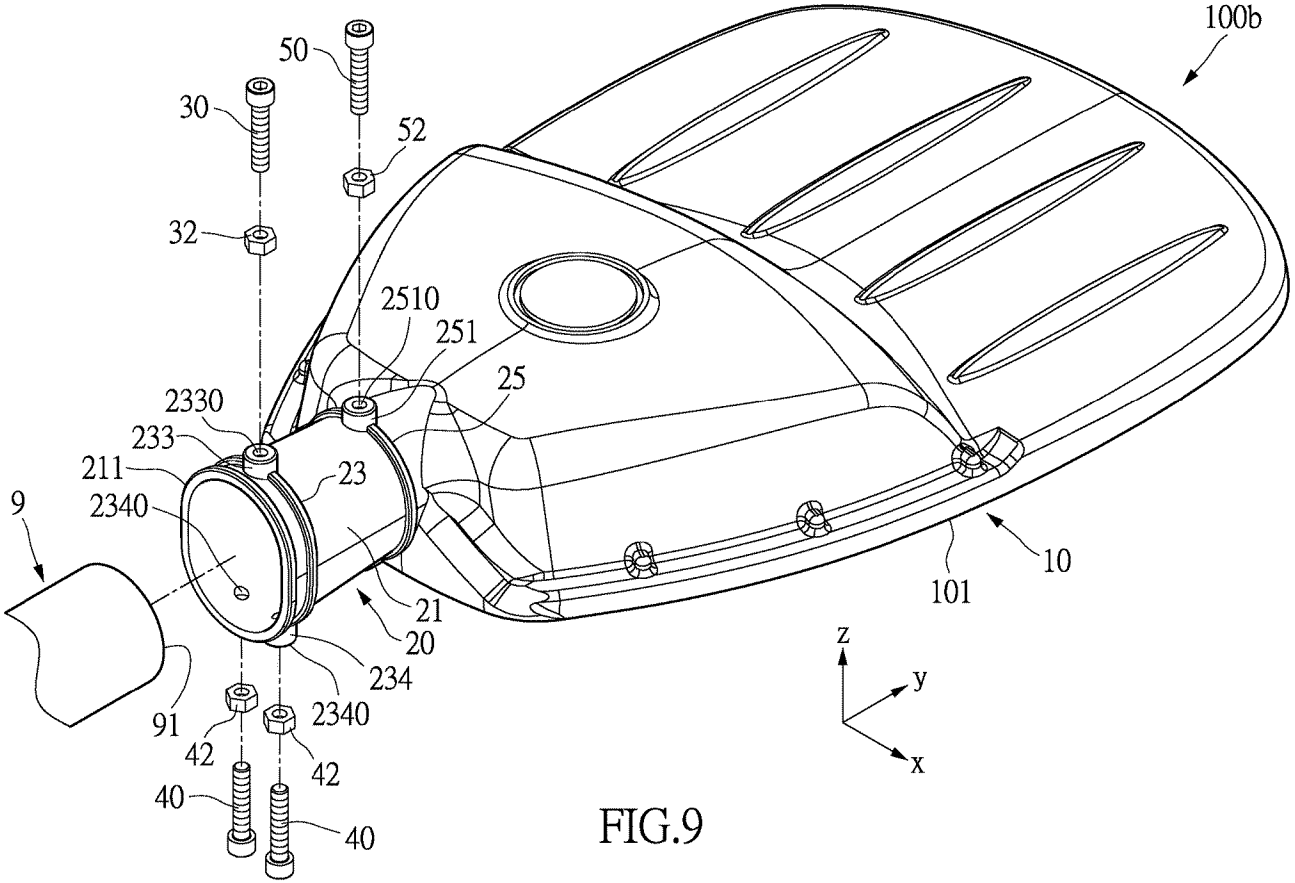
FIG. 9 is an exploded view of a lighting assembly and a light pole according to a third embodiment of the present invention.

FIG. 9 is a perspective view of a lighting assembly 100*b* and a light pole 9 according to another embodiment of the present invention. As shown in FIG. 9, the lighting assembly 100*b* is similar to the lighting assembly 100*a* of FIG. 5, but comprises two second fixing members 40 and a plurality of stop nuts 32, 42 and 52. In this embodiment, the first fixing member 30 and the two second fixing members 40 abut the outer surface of the light pole 9 in an approximately triangular arrangement, thereby firmly fixing the lighting assembly to avoid the lighting assembly from shaking left and right.

In this embodiment, a protruding strengthening rib 23 is arranged at a periphery of the holder 21 corresponding to the first fixing member 30 and the second fixing member 40. The protruding strengthening rib 23 surrounds the outer surface of the entire holder 21, so as to enhance strength of the holder 21 and avoid deformation of the holder 21 caused by the first fixing member 30 and the second fixing member 40 during a locking process. The strengthening rib 23 is further provided with threaded portions 233 and 234, a through-hole 2330 is formed through the threaded portion 233, and a through-hole 2340 is formed through the threaded portion 234.

Furthermore, a protruding strengthening rib 25 is provided at a periphery of the holder 21 corresponding to the third fixing member 50. The strengthening rib 25 can also enhance strength of the holder 21 and avoid deformation of the tube 21 caused by the third fixing member 50 during a locking process. The strengthening rib 25 is further provided with a threaded portion 251, and a through-hole 2510 is formed through the threaded portion 251.

The screw of the first fixing member 30 passes through the stop nut 32 and abuts the threaded portion 233 of the holder 21. The stop nut 32 abuts an outer end of the threaded portion 233. When the screw of the first fixing member 30 locks toward an inner portion of the holder 21, the stop nut 32 presses downward the outer end of the threaded portion 233 and presses upward a thread on the screw of the first fixing member 30, so as to fix the screw of the first fixing member 30 to the through-hole 2330. Therefore, the stop nut 32 can lock the first fixing member 30 to the threaded portion 233 for providing fastening and preventing loosening. Similarly, the second fixing member 40 can press the threaded portion 234 through the stop nut 42; the third fixing member 50 can press the threaded portion 251 through the stop nut 52, so as to fix the screw of the second fixing member 40 to the through-hole 2340.

Figure 10:
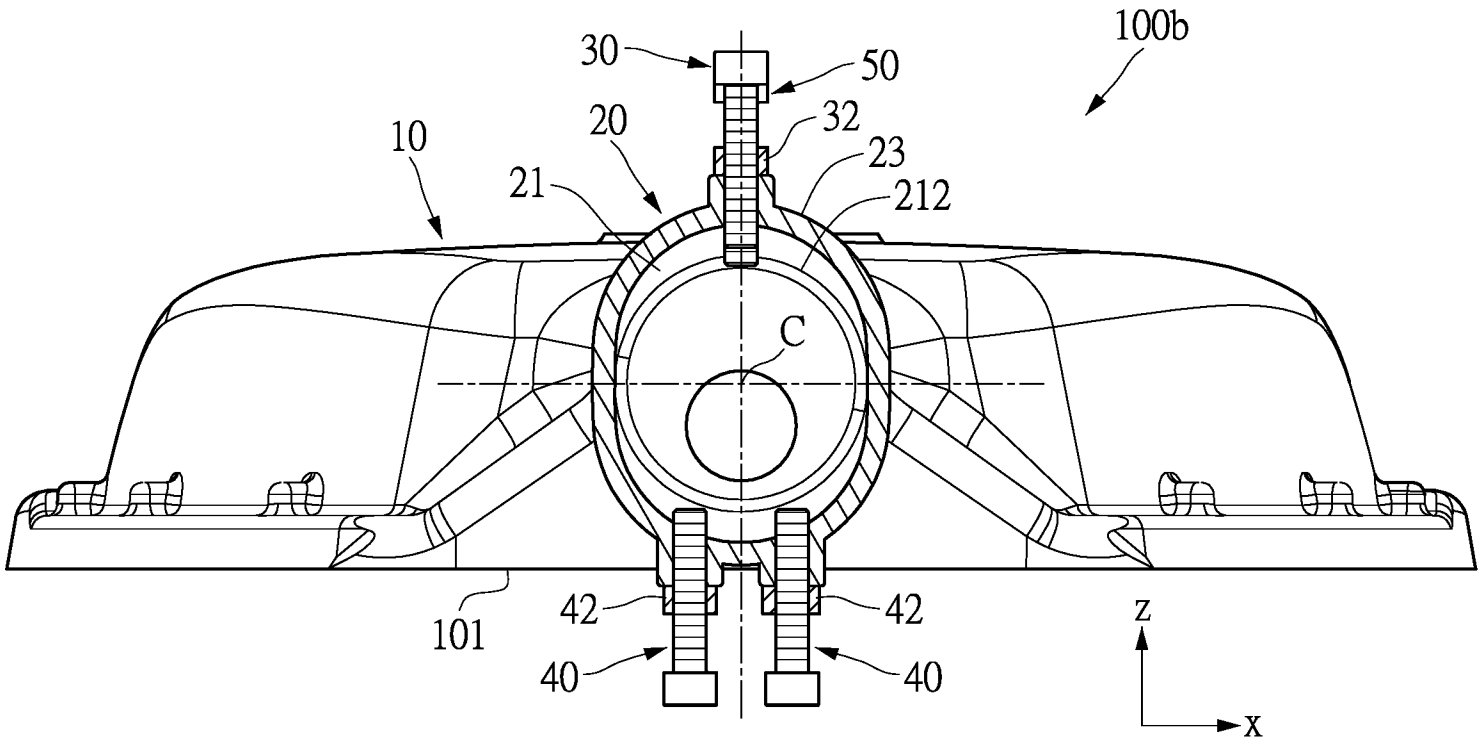
FIG. 10 is a rear cross-sectional view of the lighting assembly and light pole according to the third embodiment of the present invention.

Referring to FIGS. 9 and 10, the outer end surface 211 as shown in FIG. 9 and the inner end surface 212 as shown in FIG. 10 of the holder 21 in this embodiment are designed to have different cross-sectional shapes. The inner end surface 212 is approximately circular, and the outer end surface 211 is approximately elliptical or capsule-shaped. Widths of the holder 21 are the same along the direction of axis C, and heights of the holder along a direction passing through and perpendicular to the axis C increase from the inner end surface 212 to the outer end surface 211. The holder 21 has parallel walls at two sides thereof, a semicircular upper end and a semicircular lower end. The parallel walls at the two sides of the holder 21 may assist in limiting the holder 21, so as to avoid shifting of the lighting assembly toward right or left.

The fixing members in this embodiment are only for illustration of the present invention, but do not limit the present invention. Any mechanism that can adjust the distance between the inner wall 210 of the holder 21 and the light pole 9 may be applied in the present invention. Examples include eccentric gear, pin with adjustable height, etc.

In conclusion, advantages of the present invention include: the lighting assembly provided in the embodiments of the present invention is characterized by a simplified mechanism for adjusting a light-output angle of the light-output surface 101 through adjusting the fixing members, which in turn achieves an adjustment of a light-output angle of the lighting assembly.

The description above is only preferred embodiments of the present invention and is not intended to limit the scope of the present invention. All equivalents with technical changes made according to the specification and drawings of the present invention should fall within the scope of the present invention.

What is claimed is:

1. A lighting assembly assembled to a light pole, comprising:

a lighting portion having a light-output surface;

an assembling portion, including a holder, coupled to the lighting portion, wherein the holder including a space configured to hold a free end of the light pole; wherein inner diameters of the holder gradually decrease in a direction from an outer end surface of the holder to the lighting portion;

a first fixing member, passing through a through-hole of a first side of the holder, configured to abut the light pole; and at least one second fixing member, passing through a through-hole of a second side of the holder, configured to abutting the light pole, wherein the second side is opposite to the first side.

2. The lighting assembly of claim 1, wherein the space of the holder is a cone-cylinder space, the cone-cylinder space allows the lighting portion to adjust an angle of the light-output surface.

3. The lighting assembly of claim 1, wherein the light-output surface forms an included angle relative to a horizontal plane, and the included angle is approximately in a range between 5 and 15 degrees of elevation or depression.

4. The lighting assembly of claim 1, further comprising a third fixing member, wherein the third fixing member passes through another through-hole of the first side of the holder and abuts the light pole.

5. The lighting assembly of claim 4, wherein the third fixing member comprises a screw and a stop nut, wherein the stop nut is configured to fix the screw to the through-hole of the first side.

6. The lighting assembly of claim 1, wherein the first fixing member comprises a screw and a stop nut, wherein the stop nut fix the screw to the through-hole of the first side.

7. The lighting assembly of claim 1, wherein the second fixing members comprises a screw and a stop nut, wherein the stop nut is configured to fix the screw to the through-hole of the second side.

8. The lighting assembly of claim 1, wherein the first fixing member and the second fixing member are disposed close to the outer end surface of holder relative to the lighting portion.

9. The lighting assembly of claim 1, wherein a quantity of the second fixing portion is two, wherein the first fixing member and the two second fixing members abut the outer surface of the light pole in an approximately triangular arrangement.

10. The lighting assembly of claim 4, wherein the third fixing member is disposed closer to the lighting portion than the first fixing member, and the third fixing member and the first fixing member are disposed in alignment.

11. The lighting assembly of claim 1, wherein the outer end surface of the holder is approximately elliptical or capsule-shaped.

12. The lighting assembly of claim 11, wherein widths of the holder are the same along a direction of a central axis of the holder, and heights of the holder along a direction passing through and perpendicular to the central axis increase from the inner end surface to the outer end surface.

13. The lighting assembly of claim 10, wherein the holder has parallel walls at two sides thereof, a semicircular upper end and a semicircular lower end.

* * * * *